US006530095B1

(12) United States Patent
Dornbierer

(10) Patent No.: US 6,530,095 B1
(45) Date of Patent: Mar. 11, 2003

(54) UPWARDLY DIRECTED DOUCHE ON A SEAT OF A TOILET BOWL

(75) Inventor: Hans A. Dornbierer, Seuzach (CH)

(73) Assignee: Saninvent GmbH, Hugelshofen (CH)

( * ) Notice: Subject to any disclaimer, the term of this patent is extended or adjusted under 35 U.S.C. 154(b) by 0 days.

(21) Appl. No.: 09/830,755

(22) PCT Filed: Oct. 27, 1999

(86) PCT No.: PCT/CH99/00507

§ 371 (c)(1),
(2), (4) Date: Apr. 30, 2001

(87) PCT Pub. No.: WO00/25652

PCT Pub. Date: May 11, 2000

(30) Foreign Application Priority Data

Oct. 29, 1998 (CH) ..... 2187/98

(51) Int. Cl.[7] ..... E03D 9/08
(52) U.S. Cl. ..... 4/420.2; 4/447
(58) Field of Search ..... 4/420.2, 420.4, 4/447, 448

(56) References Cited

U.S. PATENT DOCUMENTS 2,875,450 A * 3/1959 Umann ..... 4/447
4,062,071 A * 12/1977 Blanquet ..... 4/447
4,237,560 A 12/1980 Riegelman et al. ..... 4/447
4,422,190 A * 12/1983 Huang ..... 4/447 X
5,570,479 A * 11/1996 Chomik et al. ..... 4/420.2
5,911,516 A * 6/1999 Chang ..... 4/420.2

FOREIGN PATENT DOCUMENTS

| | | |
|---|---|---|
| CH | 453 242 | 6/1968 |
| EP | 277 409 | 8/1988 |
| EP | 298 335 | 1/1989 |
| GB | 2 098 640 | 11/1982 |

* cited by examiner

*Primary Examiner*—Robert M. Fetsuga
(74) *Attorney, Agent, or Firm*—Ostrolenk, Faber, Gerb & Soffen, LLP

(57) ABSTRACT

A shower head (8) is disposed in a ring-shaped seat (2) and connected via a conduit (20) to a warm water preparation device (2) that is also arranged in said seat (2). The warm water preparation device (2) is arranged at least in the front part of the seat (2) and has a water chamber (24) in which an electric heating element (26) and a thermostat (28) controlling said element is arranged. It is possible to regulate the temperature in a simple and precise manner and also makes the seat warmer for the user.

10 Claims, 3 Drawing Sheets

UPWARDLY DIRECTED DOUCHE ON A SEAT OF A TOILET BOWL

PRIORITY CLAIM

This is a U.S. national stage of application No. PCT/CH99/00507, filed on Oct. 27, 1999. Priority is claimed on that application and on the following application: Country: Switzerland, Application No.: 2187/98, Filed: Oct. 29, 1998.

TECHNICAL FIELD

The invention relates to an upwardly directed douche on a seat of a toilet bowl.

PRIOR ART

U.S. Pat. No. 2,875,450 discloses an upwardly directed douche of the type mentioned above which, in the seat, has a plurality of douche heads which can be extended into the rinsing position. The douche heads are connected, via a line, to a water heater which is designed as a flow heater and is arranged in the seat. The flow heater has a pipe in which a heating element is arranged. For temperature control, use is made of a mechanically adjustable needle valve which restricts the flow rate of the rinsing water. This design has decisive properties which prevent the intended use from being realized in practice. The flow heater supplies cold water at the beginning of the rinsing operation and then either excessively cold or excessively hot water, since precise adjustment, in particular of the needle valve, is not possible. Pressure fluctuations in the water system thus result in temperature fluctuations or even in overheating of the rinsing water. Moreover, the seat is cold in the rest position since it can only be heated when rinsing water flows through the flow heater. The heating operation, however, usually only takes place upon completion of use, once the seat has already been heated by the user's body heat, and further heating would no longer be necessary at all.

There is also then the risk of the seat, with the flow heater active, becoming too hot. Finally, the upwardly directed douche is a closed system in which it is possible for water to be returned from the flow heater and for waste water possibly to be taken in from the toilet bowl.

CH-A-453 242 discloses a further upwardly directed douche with a douche head which can be pivoted into the rinsing position. This upwardly directed douche has proven very successful. The disadvantage, however, is that the upwardly directed douche is of relatively voluminous construction since the water heater and various control elements are fitted laterally on a seat carrier and take up a lot of space.

DESCRIPTION OF THE INVENTION

The object of the invention is to improve an upwardly directed douche of the type mentioned in the introduction.

Pursuant to this object, and others which will become apparent hereafter, one aspect of the present invention resides in an upwardly directed douche for a seat of a toilet bowl, which douche comprises a toilet seat, a douche head which can be extended into a rinsing position, a water heater in the seat, and a line that connects the douche head to the water heater. The water heater has a water chamber at least in a front part of the seat, an electric heating element arranged in the water chamber and a thermostat operatively connected to the heating element so as to control the heating element. Since the water heater arranged in the seat is designed as a water chamber with an electric heating element rather than as a flow heater, decisive advantages are attained along with a small, compact overall volume. The water chamber forms a system which has a relatively large volume and, in contrast to a flow heater, which only heats in the course of water consumption, is heated even when there is no need for any hot water. This allows straightforward and more accurate temperature regulation which can bring the water volume to the desired temperature and keep it there. The temperature regulation is unaffected by pressure fluctuations in the water supply and prevents the water from being detrimentally overheated. Hot water at the desired temperature is thus always immediately available for the rinsing operation over a relatively long period of time and the seat is already heating to a comfortable temperature for use.

According to another embodiment of the invention, the water heater may also have a safety thermostat, which is adjusted to the maximum admissible temperature.

It is possible, in principle, for the water supply and water discharge lines of the water heater to be arranged at any desired location on the seat. However, in order to prevent air-bubble formation in the water chamber, pursuant to another aspect of the invention, the douche head has openings located substantially at a highest point of the water chamber.

According to a further embodiment, the upwardly directed douche is provided with a line separator and a control valve, these being combined equiaxially, according to the invention, to form a bar-like structural unit. This produces a small structural unit which may readily be arranged in the rear part of the seat. In still another embodiment of the invention the line separator has a control piston which can be displaced in a cylinder part and has a coaxial injector through-passage with a nozzle directed towards a chamber which is connected to the water heater via a non-return valve. A spring is provided so as to prestress the control piston into a rest position in which, in an absence of water pressure, a connection between the control valve and the injector through-passage is interrupted by the control valve and the chamber is connected to a line which opens out into the toilet bowl and is closed when the control piston, with the control valve open, is displaced into a switching position. The non-return valve is directed toward the chamber and can be opened by an injector jet from the injector through-passage. This non-return valve prevents the hot water from being able to empty out of the water chamber, and pass into the water supply line, in an undesired manner.

It is possible for the douche head to be extended, for example, by a suitable push-button control means or a servo mechanism.

In still another embodiment of the invention an actuating lever is arranged laterally on the seat and connected to a pivot pin arranged on the seat and connected to the douche head so that the douche head can be extended by the actuating lever. This actuating lever provides straightforward and reliable actuation of the douche head. In a further embodiment an eccentric is arranged on the pivot pin of the douche head. A coupling device connects the eccentric to the control valve in terms of drive. The coupling device has a channel which is arranged between the eccentric and the control valve and is filled with contact elements for passing on control pulses from the eccentric to the control valve. This provides an effective, space-saving construction of the coupling device.

A cost-effective and compact construction is provided by another embodiment of the invention in which the seat has two rear articulations about which the seat can be swung up.

Each articulation includes an articulation bolt. Each of the articulation bolts has either a water supply line or an electric supply line arranged therein.

BRIEF DESCRIPTION OF THE DRAWINGS

Exemplary embodiments of the upwardly directed douche according to the invention are described in more detail hereinbelow with reference to schematic drawings, in which.

DETAILED DESCRIPTION OF THE PREFERRED EMBODIMENTS

Figure 1:
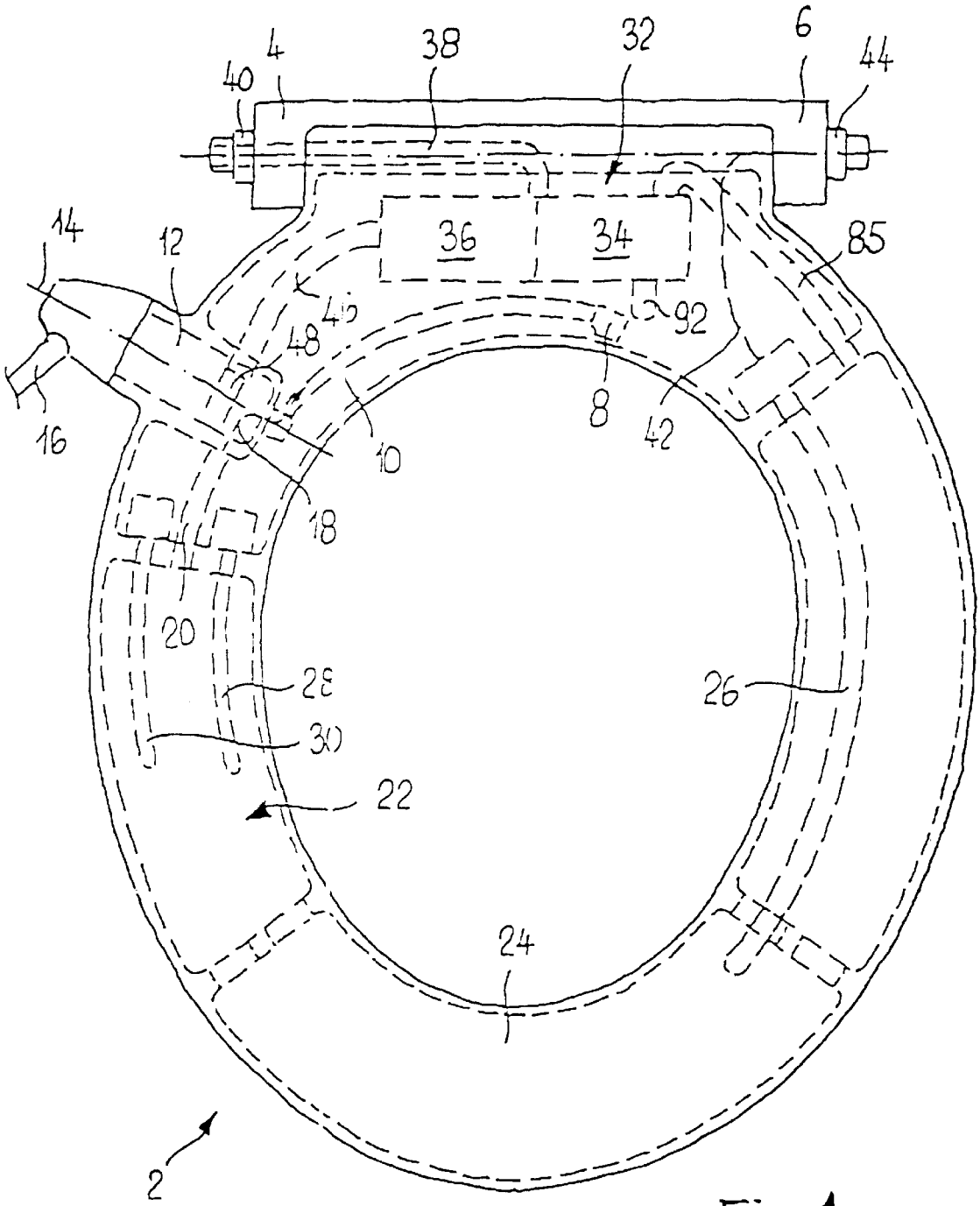
FIG. 1 shows a plan view of a seat of a toilet bowl with an upwardly directed douche.

FIG. 1 shows a seat 2 which is fastened on a toilet bowl (not illustrated) via two rear articulations 4 and 6. Each articulation 4, 6 contains a suitable braking device, for example in accordance with CH-A-453242, in order to ensure that the seat 2 is tilted downwards in a controlled manner. The upwardly directed douche contains a douche head 8 which is arranged on a pivot lever 10 and can be pivoted by means of a pivot pin 12, about an axis 14 located in the seat, from the rest position, which is shown in the figure, into an operating position, which is not illustrated specifically. In the operating position, the douche head 8 is extended into a rinsing position located in the central region of the toilet bowl and/or of the seat and is oriented upwards, i.e. approximately perpendicular to the drawing plane, in order to direct a douche jet towards the anal and/or genital region of a user. The pivot pin 12 is actuated by means of an actuating lever 16. The pivot pin 12 also contains a channel 18, which connects the douche head 8 to a water heater 22 via a line 20.

The water heater 22 is formed by a water chamber 24 which is arranged in the seat 2 and into which the line 20 opens out. An electric heating element 26 is arranged in the water chamber 24. A thermostat 28, which can preferably be regulated and likewise engages in the water chamber, makes it possible to adjust the water temperature in the water chamber 24. A safety thermostat 30 is likewise connected to the water chamber 24 and restricts the maximum admissible level to which the water in the water chamber 24 can be heated. The thermostats and the associated control means are of electronic design and allow very accurate temperature regulation, for example to an operating temperature of 38° C. or 43° C. for the maximum admissible temperature.

The water heater 22 is fed by way of a structural unit 32 which is designed multifunctionally, for regulating the quantity and pressure of the supply water, as a line separator for preventing used water from being taken back into the water supply line 38 and for preventing hot water from running out of the water heater 22 in an undesired manner. A line separator 34 and a control valve 36 are arranged equiaxially one behind the other. Connected to the structural unit 32 is a water supply line 38 which is fed in from the outside through an articulation bolt 40 of the articulation 4 of the seat 2. Analogously, an electric supply line 42 is fed in from the outside through the articulation bolt 44 of the other articulation 6. The control valve 36 is connected for actuating purposes, via a coupling device 46, to an eccentric 48 on the pivot pin 12, which is pivoted by the actuating lever 16.

Figure 2:
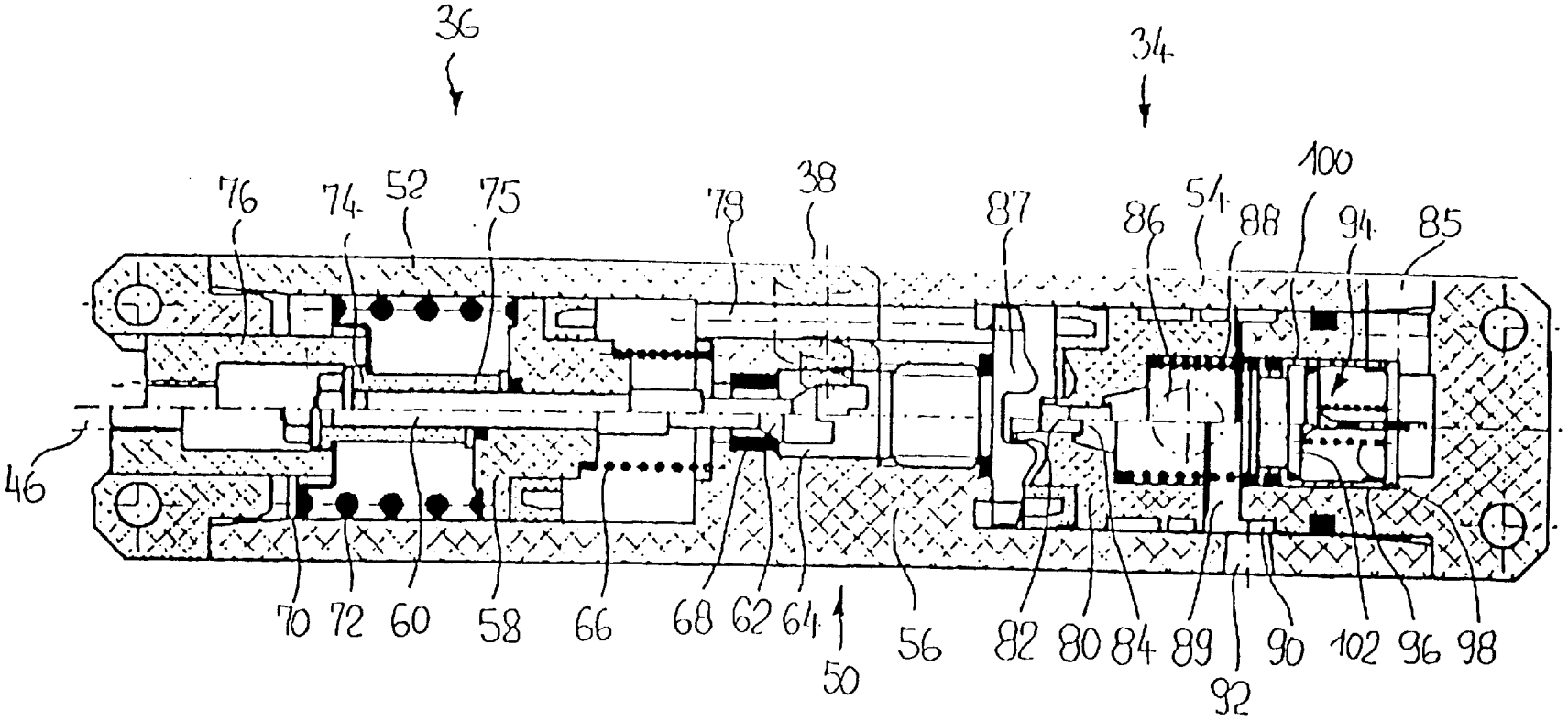
FIG. 2 shows the control part of the upwardly directed douche in detail form, on a larger scale and partly in section, the bottom half showing a control valve and a line separator in the rest position and the top half showing said control valve and line separator in the actuated position.

The structural unit 32, which comprises the line separator 34 and the control valve 36, is illustrated in more detail in FIG. 2. The structural unit 32 has a cylindrical housing 50 in which a first cylinder part 52 and a second cylinder part 54 are separated from one another by a central wall part 56. The first cylinder part 52 belongs to the control valve and contains a piston 58, which is fastened on a piston rod 60. The latter bears a conical valve element 62 which is arranged in a cutout 64 in the central wall part 56. The water supply line 38 opens out into the cutout 64. A spring 66 which is arranged on the side directed towards the valve element 62 prestresses the piston 58, and thus the valve element 62, against a valve seat 68 and retains the valve in a closed position. On that side of the piston 58 which is located opposite the valve element 62, a spring plate 70 is mounted in an axially displaceable manner on the piston rod 60 and is prestressed by means of a spring 72 against a stop 74 on a supporting sleeve 75 on the piston rod 60. The spring 72 is supported on the piston 58. Acting on the spring plate 70 is an actuating element 76, which is connected to the pivot pin 12 and the actuating lever 16 via the coupling device 46. Said design means that the control valve 36 is configured as a pressure-reducing valve as well as a quantity-reducing valve. By virtue of the actuating element 76 being actuated, first of all the spring 72 is compressed and the valve element 62 remains closed. It is only when the water pressure and the prestressing force of the spring 66 are exceeded that the valve element 62 is opened. The valve element then remains open until the prestressing force of the spring 72 is greater than the water pressure in the water supply line 38 and the prestressing force of the spring 66. The control valve 36 is connected to the line separator 34 via at least one connecting channel 78 in the wall part 56.

The line separator 34 has a control piston 80 which can be displaced in the second cylinder part 54 and, in its central region, contains a coaxial injector through-passage 82, of which the nozzle 84 is directed towards a chamber 86 which is connected to the water heater 22 via a connecting line 85. In the absence of water pressure, a spring 88 prestresses the control piston 80 into the rest position, against the valve seat 87, and thus closes the connecting channel 78 between the control valve 36 and the injector through-passage 82. In this rest position, the control piston 80 opens a through-passage 89 from the chamber 86 of the control piston 80 to an annular channel 90 and a line 92 which opens out into the toilet bowl, as a result of which the line channelling between the water supply line 38 and the water heater 72 is separated. In the case of any implosion in the water supply line 38, it is not possible, on account of the non-return valve 94 described hereinbelow, for any water to be taken back into the water supply line 38 from the water heater and the downstream douche head 8; rather, only air can be taken in via the line 92. For this purpose, the mouth opening of the line 92 is arranged freely above the water level in the toilet bowl such that it cannot take in any water from the toilet bowl either. The line separator 34 also contains the non-return valve 94, which is arranged in the chamber 86. The non-return valve 94 is formed by a sleeve 96 which is arranged in the chamber 86 and on which the spring 88 is supported. Arranged in the sleeve 96 is a valve element 102 which is prestressed against a valve seat 100 by means of a spring 98 and is opened by the water stream from the nozzle 84 of the injector through-passage 82 and releases the flow to the connecting line 85.

Figure 3:
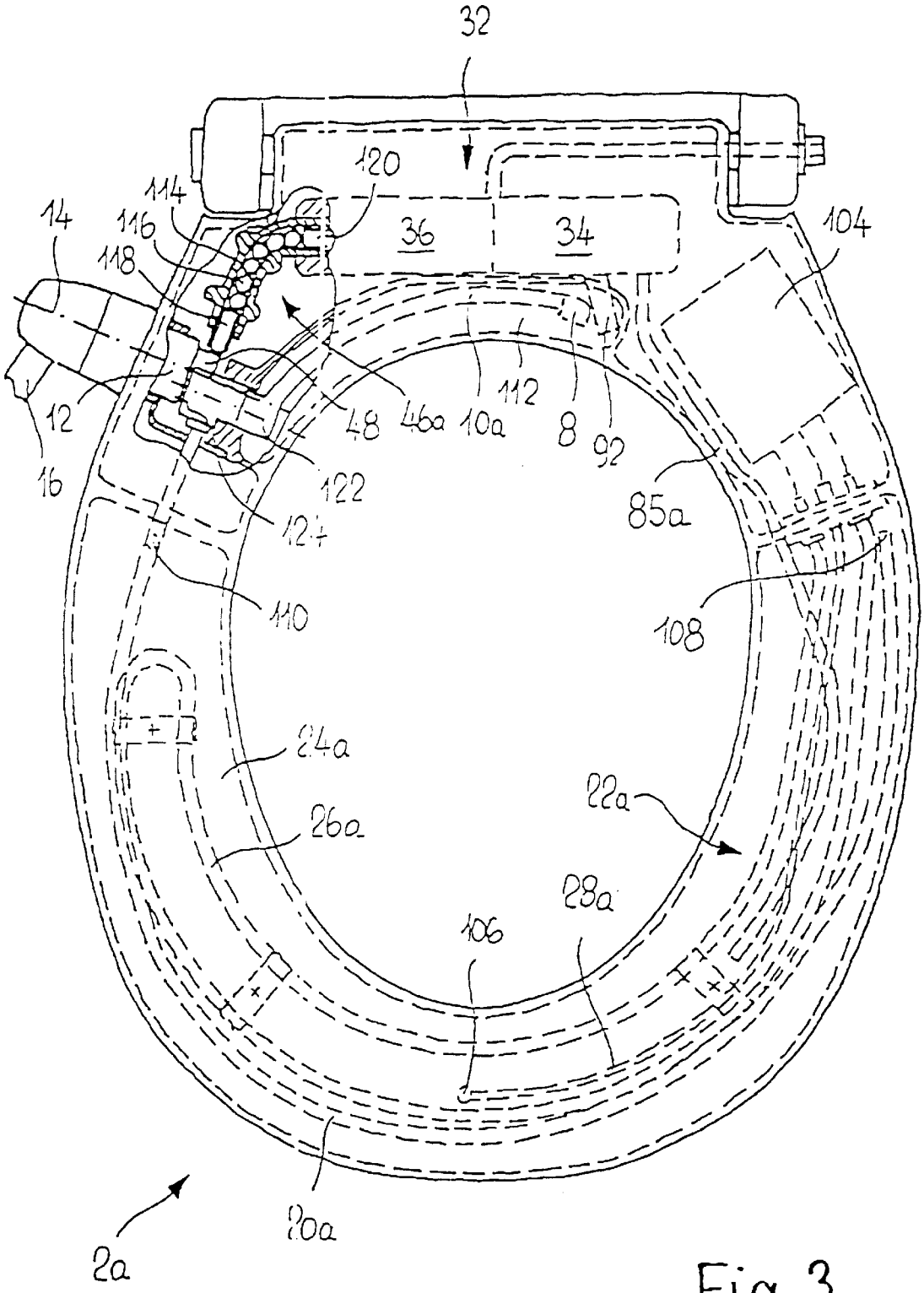
FIG. 3 shows a plan view of a modified seat with an upwardly directed douche.

FIG. 3 shows a further exemplary embodiment of a seat which has an upwardly directed douche and corresponds essentially to that from FIGS. 1 and 2, so that reference is made to what has been said above. The same parts are provided with the same designations. The modified features are indicated by the index a.

The heating element 26*a* is designed as a heating coil which extends essentially over the entire length of the water chamber 24*a*. The heating coil 26*a* is connected to a control unit 104 which is arranged in the seat 2*a* and to which the thermostat 28*a* is also connected, the measuring head 106 of said thermostat extending more or less into the foremost region of the seat 2*a*. The connecting line 85*a* for the water supply from the structural unit 32 to the water heater 22*a* opens out approximately into the first third of the length of the water chamber 24*a*. The line 20*a* from the water chamber 24*a* of the water heater 22*a* has in each case one opening 108, 110 at the ends of the water chamber 24*a*, these openings being located at the highest point of the water chamber 24*a* in order to discharge from the water chamber 24*a* any air bubbles produced.

The pivot lever 10*a* with the douche head 8 is located, in the retracted state, in a chamber 112 which is open at the bottom. The latter allows the douche head 8 to be cleaned by means of the water which overflows through the douche head during heating of the water in the water heater 22*a*.

The coupling device 46*a*, which serves for controlling the valve structural unit 32 by way of the pivot lever 10*a*, contains a curved channel 114 arranged between the eccentric 48 and the control valve 36. Said channel is filled with contact elements 116, for example balls or pressure plates, of which the diameter is adapted essentially to the internal diameter of the channel 114. The contact elements 116 are connected to the eccentric 48 via a first push rod 118 and to the control valve 36 via a second push rod 120. It is thus straightforwardly possible for the control pulses of the eccentric 48 also to be passed on to the control valve 36 via a curved path. In the example of FIG. 3, the axis 14 of the pivot pin 12 and the axis 122 of the pivot lever 10*a* of the douche head are arranged in an offset manner. An eccentric stub 124 of the pivot pin 12 serves for carrying along the pivot lever 10*a*.

As further embodiments which are not illustrated, it is possible for the water supply and/or power supply lines, rather than being arranged through the articulations, to be arranged independently of said articulations. In order to save power, it is possible to provide a toilet-seat lid which actuates a contact such that the water heater is only activated when the toilet-seat lid is open. Following opening of the lid, the heating element briefly heats the water in the chamber and the seat in order to provide a warm seat for the user.

The novel upwardly directed douche is distinguished by a very compact construction and, in practice, takes up no more space than a normal toilet seat. Furthermore, the upwardly directed douche is extremely straightforward since, rather than requiring any pumps, it functions solely by way of the control of the water pressure and the injector nozzle. The line separator forms an open system which prevents water from being taken back in from the water heater and from the toilet bowl. Furthermore, the heated water chamber in the seat achieves a seat which is warm for use and provides optimally heated water for the douche, a largely constant temperature being ensured and overheating being avoided. Heating-up of the water chamber produces a positive pressure which channels hot water to the douche head and helps to clean the latter. The novel upwardly directed douche is also suitable, in particular, for the subsequent replacement of an existing seat by the seat according to the invention with the upwardly directed douche installed therein, with the result that existing toilets can easily be retrofitted with an upwardly directed douche.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An upwardly directed douche for a seat of a toilet bowl, comprising: a toilet seat; a douche head which can be extended into a rinsing position; a water heater in the seat; a line arranged to connect the douche head to the water heater, the water heater having a water chamber at least in a front part of the seat, an electric heating element arranged in the water chamber and a thermostat operatively connected to the heating element so as to control the heating element; a water supply line; a line separator; and a control valve, the water heater being connected to the water supply line by the line separator and the control valve, the line separator and the control valve being combined equiaxially to form a bar-like structural unit and being arranged in a rear part of the seat.

2. An upwardly directed douche according to claim 1, wherein the water heater further includes a safety thermostat.

3. An upwardly directed douche according to claim 1, wherein the line connected to the douche head has openings located substantially at a highest point of the water chamber.

4. An upwardly directed douche according to claim 1, wherein the line separator has a control piston which can be displaced in a cylinder part and has a coaxial injector through-passage with a nozzle directed towards a chamber which is connected to the water heater via a non-return valve, a spring being provided so as to prestress the control piston into a rest position in which, in an absence of water pressure, a connection between the control valve and the injector through-passage is interrupted by the control valve and the chamber is connected to a line which opens out into the toilet bowl and is closed when the control piston, with the control valve open, is displaced into a switching position.

5. An upwardly directed douche according to claim 4, wherein the non-return valve is directed towards the chamber and is openable by an injector jet from the injector through-passage.

6. An upwardly directed douche according to claim 1, and further comprising an actuating lever arranged laterally on the seat and connected to a pivot pin arranged in the seat and connected to the douche head whereby the douche head can be extended by the actuating lever.

7. An upwardly directed douche according to claim 6, wherein an eccentric is arranged on the pivot pin of the douche head, and further comprising a coupling device arranged to connect the eccentric in drive terns to the control valve.

8. An upwardly directed douche according to claim 7, wherein the coupling device has a channel which is arranged between the eccentric and the control valve and is filled with contact elements for passing on a control pulse from the eccentric to the control valve.

9. An upwardly directed douche according to claim 1, wherein the seat has two rear articulations about which the seat can be swung up, the rear articulations each including an articulation bolt, and further comprising a water supply line arranged in one of the articulation bolts and an electric supply line arranged in another of the articulation bolts.

10. An upwardly directed douche for a seat of a toilet bowl, comprising: a toilet seat; a douche head which can be extended into a rinsing position; a water heater in the seat; and a line arranged to connect the douche head to the water heater, the water heater having a water chamber at least in a front part of the seat, an electric heating element arranged in the water chamber and a thermostat operatively connected to the heating element so as to control the heating element, the line connected to the douche head having openings located substantially at a highest point of the water chamber.

* * * * *